US010694776B2

(12) United States Patent
Hon

(10) Patent No.: US 10,694,776 B2
(45) Date of Patent: Jun. 30, 2020

(54) KIND OF MICROBURST-MICROCAPSULE USED FOR CIGARETTES AND SMOKING ARTICLES WITH SUCH MICROBURST-MICROCAPSULES

(71) Applicant: Lik Hon, Beijing (CN)

(72) Inventor: Lik Hon, Beijing (CN)

( * ) Notice: Subject to any disclaimer, the term of this patent is extended or adjusted under 35 U.S.C. 154(b) by 0 days.

(21) Appl. No.: 15/580,270

(22) PCT Filed: Aug. 19, 2016

(86) PCT No.: PCT/CN2016/096011
§ 371 (c)(1),
(2) Date: Dec. 6, 2017

(87) PCT Pub. No.: WO2017/193495
PCT Pub. Date: Nov. 16, 2017

(65) Prior Publication Data

US 2018/0168220 A1 Jun. 21, 2018

(30) Foreign Application Priority Data

May 10, 2016 (CN) ..... 2016 1 0306089

(51) Int. Cl.
*A24D 1/00* (2020.01)
*A24B 15/28* (2006.01)
(Continued)

(52) U.S. Cl.
CPC ..... *A24D 1/002* (2013.01); *A24B 15/24* (2013.01); *A24B 15/283* (2013.01);
(Continued)

(58) Field of Classification Search
CPC ..... A24D 3/061; A24B 15/283
See application file for complete search history.

(56) References Cited

U.S. PATENT DOCUMENTS 3,550,598 A * 12/1970 McGlumphy ..... A24B 15/283 131/274
4,566,565 A * 1/1986 Wicke ..... F16F 9/43 188/322.21
(Continued)

FOREIGN PATENT DOCUMENTS

CN 2643681 Y 9/2004
CN 2648836 Y 10/2004
(Continued)

*Primary Examiner* — Eric Yaary
(74) *Attorney, Agent, or Firm* — Bayramoglu Law Offices LLC

(57) ABSTRACT

This invention discloses a kind of microburst-microcapsule designed for cigarettes and a smoking article with such microburst-microcapsules. Wherein the microburst-microcapsule is composed of a microcapsule wall and an aerosol generation material encapsulated by the microcapsule wall. The microburst-microcapsule can be filled in cigarette. When the cigarette lights, the high temperature generated from its combustion zone will vaporize the nearest aerosol generation materials packaged in the aforesaid microburst-microcapsule. The vapor pressure will cause the microcapsule wall burst. As a result, the aerosol from the aforesaid aerosol generation materials will vapor out of the microcapsule wall. Tobacco-free carbonaceous fuels or solid carbonaceous from high temperature vacuum destructive distillation of tobacco filament can be used as combustion materials for aforesaid cigarettes.

12 Claims, 5 Drawing Sheets

(51) Int. Cl.

| | |
|---|---|
| ***A24B 15/24*** | (2006.01) |
| ***A24B 15/32*** | (2006.01) |
| ***A24B 15/38*** | (2006.01) |
| ***A24D 1/02*** | (2006.01) |

(52) U.S. Cl.
CPC ..... *A24B 15/285* (2013.01); *A24B 15/32* (2013.01); *A24B 15/385* (2013.01); *A24D 1/02* (2013.01)

(56) References Cited

U.S. PATENT DOCUMENTS

| | | | | |
|---|---|---|---|---|
| 5,019,122 | A | 5/1991 | Clearman et al. | |
| 9,149,072 | B2 | 10/2015 | Conner et al. | |
| 9,185,939 | B2 | 11/2015 | Jarriault et al. | |
| 9,220,301 | B2 | 12/2015 | Banerjee et al. | |
| 2003/0098033 | A1* | 5/2003 | MacAdam | A24D 1/12 131/344 |
| 2008/0163877 | A1* | 7/2008 | Zhuang | A24D 3/061 131/71 |
| 2008/0175918 | A1* | 7/2008 | Laulicht | A61K 9/5031 424/490 |
| 2011/0062036 | A1* | 3/2011 | Xie | A61K 9/4808 206/222 |
| 2013/0089602 | A1* | 4/2013 | Boday | A61K 9/1647 424/451 |
| 2014/0261486 | A1 | 9/2014 | Potter et al. | |
| 2015/0183575 | A1* | 7/2015 | Doglioni Majer | B65D 85/8043 99/295 |
| 2015/0296874 | A1* | 10/2015 | Awty | B01J 13/04 131/337 |

FOREIGN PATENT DOCUMENTS

| | | | | |
|---|---|---|---|---|
| CN | 201821901 | U | 5/2011 | |
| CN | 2004200311820 | A | 4/2014 | |
| CN | 205695718 | U | 11/2016 | |
| EP | 1781125 | A2 | 5/2007 | |
| GB | 1410048 | A | 10/1975 | |
| WO | WO-0057713 | A1 * | 10/2000 | A23F 3/405 |
| WO | 2015084783 | A1 | 6/2015 | |
| WO | 2016063181 | A1 | 4/2016 | |

* cited by examiner

KIND OF MICROBURST-MICROCAPSULE USED FOR CIGARETTES AND SMOKING ARTICLES WITH SUCH MICROBURST-MICROCAPSULES

CROSS REFERENCE TO RELATED APPLICATIONS

This application is the national phase entry of International Application No. PCT/CN2016/096011, filed on Aug. 19, 2016, which is based upon and claims priority to Chinese Patent Application No. CN201610306089.3, filed on May 10, 2016, the entire contents of which are incorporated herein by reference.

TECHNICAL FIELD

Involved in the invention is a kind of filling material used for cigarettes and the smoking articles with such filling materials.

BACKGROUND

Ordinary tobacco product, for example cigarette, is made by wrapping cigarette paper around cut tobaccos in the shape of round bar or rod. More often than not, a filtering device, for example a filter tip made of cellulose acetate, is attached to the smoking end of cigarettes. When the smoker lights a cigarette and puffs, the cut tobaccos in cigarette will get burnt and carbonized to form a flame-free hot combustion zone. The combustion zone, gradually expanding backward, will give rise to high-temperature air flow which exerts a carbonization effect on neighboring cut tobaccos. Besides, the high-temperature air flow will vaporize the volatiles contained in the cut tobaccos and generate visible aerosol, namely whitish and lightly-bluish vapor, when such volatiles are cooled by the incoming cooling air. The nicotine contained in such vapor will be breathed into human blood system through respiratory tract as well as pulmonary alveoli and then excite cerebral nerve cells, exposing smokers to the pleasant feeling exclusive to nicotine. However, the decomposition and double-decompose reactions of various chemicals from tobaccos will give rise to large quantities of tar and diversified harmful substances. Hence it comes as a constant challenge to cigarette manufacturers to bring smokers the pleasant feeling created by mildly-harmful nicotine while minimizing tar and hazardous substances. To significantly improve the public health environment and weaken the harm of tobaccos and the resulting law conflicts, great efforts are being made in relevant technological improvements and inventions. R.J Reynolds Tobacco Company has described, in a number of technological patents, the low-tar cigarettes with segment-based combustion element fueled by carbon. Also relevant technologies have been disclosed in such USA patents as U.S. Pat. Nos. 9,220,301, 9,149,072 and the U.S. Pat. No. 9,185,939 of Philip Morse.

In order to reduce the harm caused by smoking, people also attempted to improve the filter. For example, a filter disclosed in GB1410048, in its longitudinally extending region, set the filter paper with high permeability, which divides into at least one channel provided for the smoke fog and at least one carbon-filled area. And carbon hereof is taken as the absorbent to absorb the components in the cigarette smoke. Chinese Patent CN201821901U discloses a composite microcapsule cigarette filter, wherein, attached to one end of the filter rod, be fitted with a filter chip, and on the coated paper outside of the filter chip opens the suction hole, to enable the filter to adsorb the harmful substances in the smoke.

The present inventor also applied to patents of electronic cigarette powered by battery, including the Chinese utility model patents ZL03211903.8, ZL03212882.7 and ZL200420031182.0, etc. in 2003 and 2004. These inventions are intended to provide the smokers with low-tar cigarettes with advantages of traditional cigarettes and as little as possible the incomplete combustion and pyrolysis products. However, the flavor generated from the heat source instead of tobacco and the visible aerosol with flavor of tobacco, are not favorable to people.

Clearly, people prefer that the flavor and organoleptic effects of the smoking articles are close the traditional cigarettes, while they will not bring more harmful products of incomplete combustion and pyrolysis remains.

SUMMARY

To provide a good solution to the above-mentioned dilemma, a kind of microburst-microcapsule is invented, which can be filled into a body of cigarette to create a safer smoking article for smokers.

A microburst-microcapsule for a smoking article proposed in this invention, wherein the microburst-microcapsule is fillable into a body of the smoking article; the microburst-microcapsule consists of a microcapsule wall and an aerosol generation material packaged in it; when the cigarette is lighted, heat generated from its combustion zone will vaporize adjacent aerosol generation materials in the microburst-microcapsule, vapor pressure causes the capsule wall to burst and aerosol generated from the aforesaid aerosol generation materials will flow out of the capsule wall.

If the material of the capsule wall is low flash point cellulose or other similar materials, the wall will be combusted and decomposed without burst.

Solutions provided by the invention are shown as follows:

The solution is about a microburst-microcapsule designed for cigarettes. Consists of capsule wall and aerosol generation materials encapsulated by the capsule wall, the microburst-microcapsule can be filled in cigarettes. When a cigarette is lighted, the high temperature in combustion zone will vaporize the aerosol generation materials in the above-mentioned microburst-microcapsules adjacent the combustion zone until the capsule wall bursts and results in fusing deformation. Consequently the aerosol from the aforesaid aerosol generation materials will vapor out of the capsule wall. The aerosol generation materials can vary from liquid to gel or solid-liquid mixture as the case may be.

Besides, the aforesaid capsule wall can be made of metal foil, low-temperature glass, and polymer materials with high temperature resistance, ceramic materials or cellulose. The above-mentioned metal foil used for preferred capsule wall varies from aluminum foil, copper foil, tinfoil, nickel foil, aluminum alloy foil, copper alloy foil, tin alloy foil or nickel alloy foil. The aforesaid polymer material refers to aramid membrane, synthetic fiber and the cellulose involved in the invention is natural cellulose and other cellulose.

Due to different capsule wall materials, herein propose an optimization plan. A microburst-microcapsule for a smoking article, wherein the microburst-microcapsule is fillable into a body of the smoking article; the microburst-microcapsule consists of a microcapsule wall and an aerosol generation material packaged in it; when the cigarette is lighted, heat generated from its combustion zone will vaporize adjacent aerosol generation materials in the microburst-microcapsule, vapor pressure causes the capsule wall to burst without fusing deformation, and aerosol generated from the aforesaid aerosol generation materials will flow out of the capsule wall. The material of the microburst-microcapsule wall should at least one of copper foil, nickel foil, polymer with high temperature resistance, ceramic material and other similarly materials. Capsule wall with aforesaid materials may not cause fusion deformation during cigarette burning but remain in ash. High temperature resistance polymer material refers high flash point aramid member, synthetic fiber (like high temperature burning resistance cellulous fiber) and ceramic materials.

Due to different capsule wall materials, herein propose another optimization plan. When the cigarette is lighted, heat generated from its combustion zone will vaporize adjacent aerosol generation materials in the microburst-microcapsule, vapor pressure causes the capsule wall to burst and burning decomposition, aerosol will flow out of the capsule wall. Such microburst-microcapsule using combustible low temperature polymer, like low flash point aramid member and synthetic fiber, etc.

The microburst-microcapsules are blended with the combustion materials of cigarettes in this invention. When a cigarette burns gradually backward, the high temperature from the hot combustion zone will heat the adjacent microburst-microcapsules. As a result, the aerosol generation materials vapor out of the capsule wall. As the capsule wall is not made of excipients or film-forming materials used for existing microcapsules, only fusion deformation takes place, without chemical reactions. This avoids the generation of harmful chemicals from the capsule wall under high temperature.

The lateral microburst-microcapsule diameter which is perpendicular to the longitudinal direction of the above-mentioned cigarette is less than 2 millimeters. The optimal lateral diameter measures between 0.05 and 0.5 millimeters.

In addition, the aerosol generation materials encapsulated by the microburst-microcapsule weigh between 0.0001 mg and 50 mg. The standardized weight ranges from 0.001 mg to 50 mg and the optimal weight ranges from 0.001 mg to 2 mg. Besides, the microburst-microcapsule can be made in diversified shapes, including strip shape, spherical shape, hemispherical shape, long and circular shape, hemi-long-circular shape, tabular shape, columnar shape, squared shape, granular shape, fine-fiber shape and so on. The fine-fiber shape, namely the thin and long strip-like object with the aspect ratio more than 3, is prioritized. The optimal weight for the aerosol generation materials encapsulated by the fine-fiber-like microburst-microcapsule ranges from 3 mg to 20 mg.

What's more, pre-burst-cracks are etched on the surface of the capsule wall.

Besides, the above-mentioned fine-fiber-like microburst-microcapsule is hollow and made of cellulose through spinning technologies. During the spinning process, the aforesaid aerosol generation materials are added to form the fine-fiber-like microburst-microcapsule in which the cellulose servers as capsule wall.

Based on the invention concepts mentioned above, a kind of siamesed microburst-microcapsule is invented. The neighboring microburst-microcapsules are jointed as one by the sealing portion in between the aforesaid capsule walls. The number of the microburst-microcapsules in the siamesed microburst-microcapsule is no less than 2.

In addition, the capsule wall of the microburst-microcapsule is formed by the tubule produced by extending such materials as metal foil, low-temperature glass, polymer materials with high temperature resistance or ceramic materials. Once the aerosol generation materials have been filled, continuous encapsulation is conducted to form the siamesed microburst-microcapsules.

Based on the microburst-microcapsule and siamesed microburst-microcapsules mentioned above, a kind of smoking article filled with combustion materials and embedded with one or more than one microburst-microcapsule/siamesed microburst-microcapsule is invented.

Furthermore, the combustion material wherein is mainly tobacco and/or carbonaceous fuel. The microburst-microcapsules and/or siamesed microburst-microcapsules, hereof mixed with the combustion material, are filled in the body of the cigarette.

Further preferably, wherein the carbonaceous fuel claimed is the filament that is made by cutting tobacco stems, reconstituted tobacco sheet or other plant stems and leaves, and it is porous carbide made by high temperature vacuum destructive distillation; or the filament hereof is made by solvent extraction of tobacco stems and reconstituted tobacco sheet.

Furthermore, wherein the combustible material claimed is further added one or a mixture of such substances as alumina, magnesium sulfate, calcium sulfate, diatomaceous earth, calcium carbonate, to improve the property of ash.

Furthermore, the carbonaceous fuel wherein is mixed with short cotton fibers and/or carbon fiber, in order to maintain a stable combustion.

Furthermore, the carbonaceous fuel wherein is mixed with glass fibers and/or silicide to keep the shape of the ash after combustion.

Furthermore, between the outer wrapping material of the cigarette wherein and the combustion material, set an insulation layer to keep the combustion ashes.

Furthermore, wherein the material of the insulation layer is non woven made of glass fibers, ceramic fibers or quartz fibers.

Furthermore, the smoking article hereof is the cigarette rod that is made by rolling the cigarette paper around the cigarette material.

Furthermore, a column or flake shaped microburst-microcapsule can be made. Such microburst-microcapsule is a signal product part and can have one or more cavities which filled with aerosol generation material. Such microburst-microcapsule can be warped in cigarette or insert into normal cigarette by smoker themself to use.

The present invention provides a smoking article, with substantially the same shape and the same way to smoke and to be lighted as the traditional cigarettes, which do not make smokers feel significantly different from a conventional cigarette. The microburst-microcapsules of this invention may be adapted to be filled with different types of burning materials or hybrid mixed materials; wherein the hybrid mixing, refers to orderly or disorder, uniform mixing and uneven blending and mixing; wherein the so-called filling means that, the microburst-microcapsules are built internally, or distributed in the combustion material, or the microburst-microcapsules are distributed or rolled around the outside of the fuel material. The aerosol generation material of microburst-microcapsule can be pre-set, according to the demand. The present invention may apply any aerosol generation material available for the smoking article, such as those used in the electronic cigarette products, and the following formula of aerosol generating material may also be used: In terms of percentage by weight, comprising: propylene glycol (20-100%), glycerin (0-80%), tobacco extract (dry weight) (0-30%), nicotine (0-10%), monobasic and dibasic C1-C6 organic acids (0-10%) (such as carbonic acid, acetic acid, pyruvic acid, malic acid, citric acid, etc.), tobacco flavor (0-10%), ethanol (0-10%) and water, 0-10%; the preferable aerosol generating material composition is: propylene glycol (50-70%), glycerol (20-40%), ethanol (4-6%), water (4-6%); more preferably, the optimum composition is: propylene glycol (60%), glycerol (30%), ethanol (5%), water (5%).

If carbonaceous combustion materials are used, the best way to preserve the unique taste and flavor of cigarettes is to add nicotine/tobacco extracts into the aerosol generation materials. In addition, the change in the blending ratio of propylene glycol and glycerol will adjust the bursting temperature of microburst-microcapsule. And the change in the addition quantity of water and ethanol will adjust the bursting pressure of microburst-microcapsule. To better steady the burst of the microburst-microcapsule, the optimal practice is to add a small quantity of zeolite powder or alumina powder, diatomaceous earth powder or other substances with the same effect to the aforesaid aerosol generation materials.

BRIEF DESCRIPTION OF THE DRAWINGS

For better understanding of the following figures, reference to the application embodiments is recommended. These illustrative figures do not serve as restrictions to technological solutions of this invention.

REFERENCE DESIGNATORS

Figure 1:
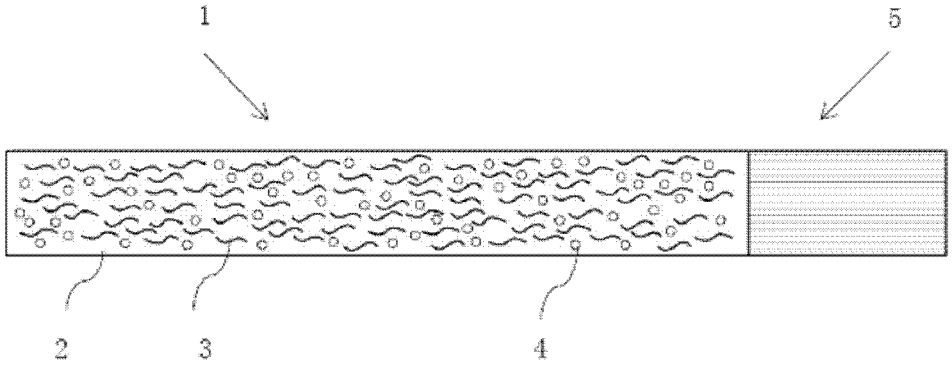
FIG. 1 is a longitudinal sectional view of microburst-microcapsule cigarette in application embodiment I of the invention.

1—the body of cigarette, 2—the cigarette paper, 3—combustible material, 4—microburst-microcapsules, 41,42,43—the capsule wall, 411—preloading pit, 412—pre-burst-crack, 5—filter, 6—insulation layer, 7—aerosol generation material, 8—sealing portion, 91,92,93,94—siamesed microburst-microcapsules, high temperature burst zone—A, the hot combustion zone—B.

DETAILED DESCRIPTION OF THE INVENTION

The following drawings and specific embodiment will further describe the present invention in detail. For the terms used herein, the combustion material refers to any filling material used in the smoking articles, particularly the cigarettes, which can be either the conventional material, such as cut tobacco, shredded tobacco, tobacco particles, or the tobacco handled by particular approach, such as tobacco leaf and stem filament through destructive distillation or extraction (of course, different degree of carbonization or extraction of tobacco leaf filament can provide different grade of tobacco taste), tobacco with low content of nitrosamine, tobacco with low content of tar, protein removed tobacco, tobacco with low protein by carbonization and the like. The carbonaceous fuel preferably used in the present invention, in particular, is porous carbide made by cutting the tobacco leaf, tobacco flakes or other artificial plant stems and leaves into filaments, then through high-temperature vacuum destructive distillation. As an option, the carbonaceous fuel hereof can be further added with the important tobacco extract components (such as nicotine, tobacco flavor substance, etc.); or further added the one or a mixture of more kinds of filler material, such as aluminum, magnesium sulfate, calcium sulfate, silicon diatomaceous earth, calcium carbonate and other materials, to improve the ash characteristics. As for the specific addition ratio, it is upon the purpose to maintain the desired smoldering combustion rate of the cigarette. Of course, alternatively, the combustion material may employ the carbon rod used in the prior art, a carbonized solid fuel.

The above-mentioned aerosol generation materials refer to those suitable for tobacco products. The invention can adopt, but not limited to, the random compounds or composition of two or more than two of the following substances: propylene glycol, glycerol, tobacco extracts (dry weight), nicotine, monobasic and dibasic C1-C6 organic acids, tobacco spice, ethanol and water. Alternatively only propylene glycol is used as aerosol generation material. To satisfy the demands of smokers and enrich the flavor of cigarettes, an appropriate amount of tobacco spices, such as sweetener, agilawood, mint, licorice, flavor and so on, can be added to the aerosol generation materials. Based on market demands, the priority practice is to add an appropriate amount of nicotine and/or tobacco extracts to minimize the addition amount of conventional tobaccos or without using tobaccos. For an accurate adjustment of the bursting temperature of microburst-microcapsules, the addition amount of propylene glycol and glycerol can be altered during the manufacturing process. With more glycerol added, the microburst-microcapsules burst at a certain high temperature and the aerosol generation materials produce smaller vapor drops, in the form of bluish smoke. Increasing the proportion of propylene glycol will result in reduced bursting temperature, however, the aerosol generation materials produce relatively big vapor drops, in the form of whitish smoke. For an accurate adjustment of the bursting pressure of the microburst-microcapsules, the addition amount of water and ethanol can be increased. This will significantly reduce the bursting temperature of microburst-microcapsules. Besides, the addition of more water will minimize the nicotine irritation to respiratory tract.

Filter tip, the back part of cigarettes, can be either used simply as a component or a practical element integrating different functions. For example, it can be used to filter out solid ashes from cigarettes; furthermore it can remove a part of tar and other harmful substances from the cigarette, and minimize the post-smoking discomforts to smokers. The filter tip can be made of such common materials as cellulose acetate, polyester mesh, and polypropylene mesh and so on. Certainly there are other filter tips with special functions and structural designs. There are no restrictions to the structure, material and function of filter tip in the invention.

As shown in FIG. 1, the present invention provides a microburst-microcapsule smoking article, comprising a tobacco body 1 and a filter 5. The cigarette is rolled by paper 2, and sealed into a synthesis rod. The fuel material 3 of the tobacco body 1 is homogeneous. A rear portion of the tobacco body 1 is the filter 5. Tobacco body 1 includes a combustion material 3 and a plurality of microburst-microcapsules 4, the combustion material 3 hereof employs the traditional tobacco, such as tobacco cut filaments, and it can also employ the extract-treated processed tobacco, such as the filaments made by solvent extraction and shredding of tobacco leaf and reconstituted tobacco sheet, the solvent hereof may be, but not be limited to, an organic solvent or carbon dioxide. Further favorably, choose the carbonaceous fuel as the combustion material, to reduce the harmful substances in tobacco. The carbonaceous fuel hereof may adopt the porous carbide. It's made by cutting tobacco leaf, reconstituted tobacco sheet or other plant stems into filaments, and then using high temperature vacuum destructive distillation. Based on different materials of the wall and processing technology, microburst-microcapsules 4 can be made into, but not be limited to the shape of strip (FIG. 2), spherical with a convex (FIG. 4), spherical (FIG. 6) and filamentous (FIG. 7) and the like. Microburst-microcapsules structure will be described in detail later. As shown in FIG. 1, before rolling, microburst-microcapsules 4 is uniformly mixed with the filamentous combustion fuel 3, and then warped by the cigarette paper roll 2 by machine into the cigarette body 2, and assembled with the filter 5, get the finished cigarette.

Figure 2:
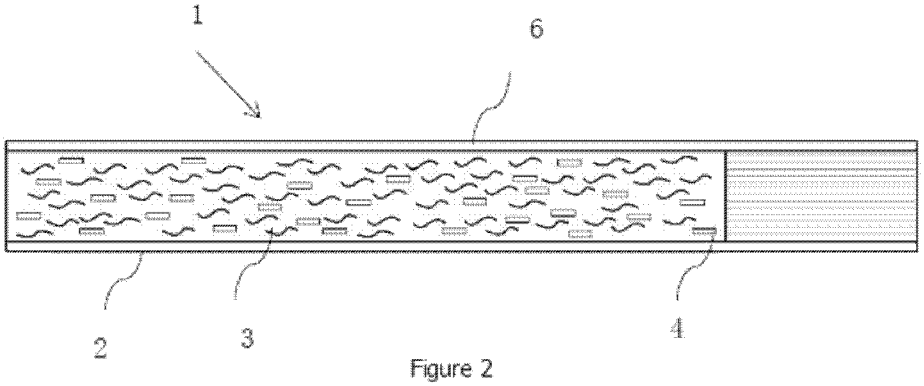
FIG. 2 is a longitudinal sectional view of microburst-microcapsule cigarette with heat insulation layers in application embodiment II of the invention.
Figure 3:
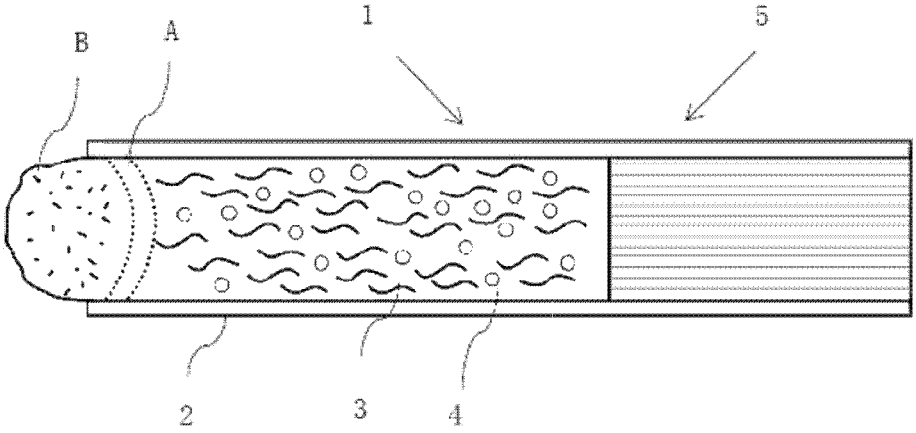
FIG. 3 is the status diagram of a lighted smoking article in this invention. The diagrammatic sketch of the microburst-microcapsule in high-temperature bursting zone A behind the hot combustion zone B during the combustion process of cigarettes is displayed here.

As shown in FIG. 2, the different of present embodiment and the aforementioned embodiment is the insulation layer 6 and the shape of microburst-microcapsules. The insulation layer 6 is disposed between the cigarette paper 1 and the combustion fuel 3. The layer is non-woven, made from fiber, ceramic fiber or quartz fiber, to keep the combustion ashes. In the present embodiment, microburst-microcapsules 4 can be selected the shape of bar as shown in the graph, whose cross section is a rectangular.

In the following part, microburst-microcapsule 4 will be elaborated. FIGS. 4,5,6,7 show three different morphologies of microburst-microcapsule 4. In order to clearly illustrate features of the present invention, the capsule wall is transparent, and the aerosol generation material can be visually seen in the capsule wall. In fact, whether the wall is transparent or not, depends on the materials of the wall of capsule in use.

Figure 4:
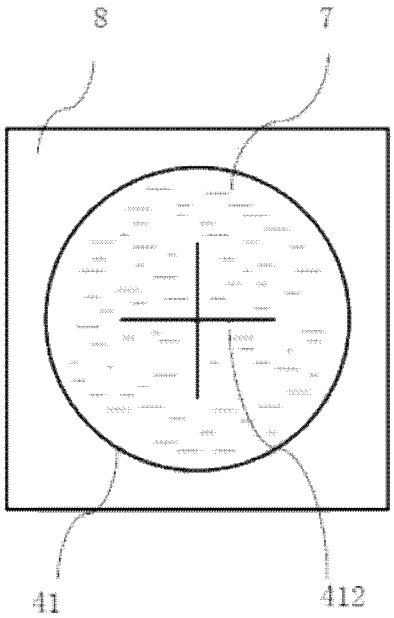
FIG. 4 is the front view of microburst-microcapsule application embodiment I in the invention. Here we can see microburst-microcapsule made of metal foil and filled with liquid aerosol generation materials or liquid-solid mixtures.
Figure 5:
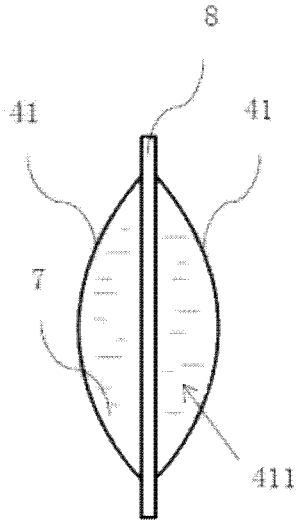
FIG. 5 displays the side view of FIG. 4.

As shown in FIGS. 4 and 5, the material of the wall 41 of microburst-microcapsule 4 applies metal foil, and the metal foil includes, but not limited to, aluminum foil, copper foil, nickel foil or the corresponding aluminum alloy foil, copper alloy foil, tin alloy foil, nickel alloy foil, etc. The aerosol generating material used to produce aerosols is encapsulated inside the wall, whose morphology is preferable to apply a liquid or solid-liquid mixture. In this embodiment, the aerosol generation material 7 is made by 50% of propylene glycol, 30% glycerol 5% of nicotine, 1.5% tobacco extract, 0.5% tobacco flavor, 3% of water, 10% of ethanol, a trace amount of zeolite powder or alumina powder. Take the outer side of the wall as a baseline of measurement (not including the outwardly projecting sealing portion), the average diameter of the single microburst-microcapsule 4 is between 0.1-2 mm, preferably in 0.3-1 mm, the diameter hereof refers to the lateral diameter, i.e., the lateral diameter perpendicular to the longitudinal direction of the cigarette. The weight of the aerosol generation material 7 encapsulated in each microburst-microcapsules 4 is between 0.0001 mg to 5 mg.

As is known to technicians of this focusing area, any one of the current workable encapsulating technologies will do if metal foil is used as material for capsule wall 41. As to the manufacturing technologies, one way is to conduct die-based prepressing of pre-loading pit 411 with two pieces of metal foils. Each pre-loading pit 411 can be made, but not limited to, in hemispherical and semi-elliptical shapes (semi-long- and circular shape). After being filled with aerosol generation material 7, the pre-loading pit 411 is sealed through ultrasonic welding or laser scanner welding. After trimming the rim charge at sealing portion 8 between capsule walls with stamping die, the manufacturing of pre-loading pit 411 is completed. Taking another manufacturing process for example, the metal foil coated with thermo sensitive glue is used for prepressing of pre-loading pit 411. After being filled with aerosol generation material 7, the pre-loading pit 411 undergoes thermo compression at the die to form encapsulated microburst-microcapsule 4. According to FIGS. 4 and 5, if the sealing portion 8 of the metal-foil capsule wall 41 of microburst-microcapsule 4 remains, in a bulge manner, at the microburst-microcapsule due to different processing technologies, it is likely to form a ring of closed bulge as shown in the figure. For an optimal effect, pre-burst-crack can be etched at the capsule wall 41 of microburst-microcapsule 4. There are no restrictions to the shape and depth of the pre-burst-cracks, which can vary from straight-line shape to cross shape and Union Jack shape. What is shown in FIG. 4 is a cross-shaped pre-burst-crack. This is to weaken the bursting sound from microburst-microcapsule 4 during smoking. Additionally appropriate reduction in the quantity of liquid filled in microburst-microcapsule 4 is able to minimize such bursting sound as well.

When the cigarette embedded with microburst-microcapsule 4 is lighted and puffed on, the combustion material 3 begins burning and the burning speeds up every time the cigarette is puffed on. A hot combustion zone B, which moves gradually toward the filter tip 5, is formed. Accordingly microburst-microcapsule 4 adjacent the hot combustion zone B is within a high-temperature zone which then forms the high-temperature bursting zone A of the microburst-microcapsule, as shown in the dashed box of the figures. On conditions of high temperature, the liquid aerosol generation materials in microburst-microcapsule 4 located in the high-temperature bursting zone A will vapor and thus the internal microcapsule pressure rises, resulting in bursting of microburst-microcapsule 4. The liquid is first vaporized by high temperature and then cooled by incoming air to form filmy and visible aerosol which is breathed by smokers through the filter tip 5. During this process, the pre-loading pit 411 and pre-burst-crack 412 in the capsule wall will expand and bulge outward until finally burst with the rise in internal capsule pressure.

Figure 6:
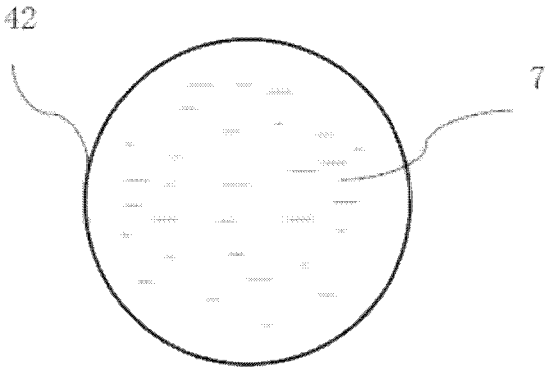
FIG. 6 is the front view of the microburst-microcapsule application embodiment II in the invention. A globular microburst-microcapsule filled with liquid aerosol generation materials is in display.

Referring to FIG. 6, there is a substantially spherical microburst-microcapsules 4, which comprises the wall 42 and liquid aerosol generation material 7 packaged therein. The aerosol generating material 7 is made from 50% of propylene glycol, 30% of glycerin, 2% of nicotine, 9% tobacco extract, 4% of water and 5% ethanol. The capsule wall 42 employs low-temperature glass or ceramic materials, after the aerosol generation material 7 is filled into the wall 41, it is sealed. The average diameter of the single microburst-microcapsules 4 is between 0.1 to 2 mm, preferably between 0.2-0.8 mm. The weight of the aerosol generation material 7 encapsulated in each microburst-microcapsules 4 is between 0.0001 mg to 5 mg. If the wall employs high temperature resistant polymer material with the melting point higher than 350° C., such as aramid membrane, the diameter of microburst-microcapsules 4 can be further narrowed, less than 0.05 mm.

The microburst-microcapsule is fillable into a body of the smoking article; the microburst-microcapsule consists of a microcapsule wall and an aerosol generation material packaged in it; when the cigarette is lighted, high temperature generated from its combustion zone will vaporize adjacent aerosol generation materials in the microburst-microcapsule, vapor pressure causes the capsule wall to burst, as a result, aerosol generated from the aforesaid aerosol generation materials will flow out of the capsule wall.

Preferably, in the above-described embodiment, to make the combustion process stable, short cotton fibers and/or carbon fiber can be incorporated into the carbonaceous fuel, and the glass fibers and/or silicide can also be incorporated into the carbonaceous fuel to keep the ash morphology after combustion.

The above mentioned embodiments, the microburst-microcapsule is fillable into a body of the smoking article; the microburst-microcapsule consists of a microcapsule wall and an aerosol generation material packaged in it. If the material of the capsule wall (like aluminum foil, other metal foil, low temperature glass and suitable polymer) can be fused under cigarette burning temperature, then when the cigarette is lighted, heat generated from its combustion zone will vaporize adjacent aerosol generation materials in the microburst-microcapsule, vapor pressure causes the capsule wall to burst, and aerosol generated from the aforesaid aerosol generation materials will flow out of the capsule wall. The heat results in partly or completely fusing deformation of the capsule wall. If the microburst-microcapsule wall is made of copper foil, nickel foil or others with high temperature resistance properties, when the cigarette is lighted, heat generated from its combustion zone will vaporize adjacent aerosol generation materials in the microburst-microcapsule, vapor pressure will cause the capsule wall to burst. However due to the high temperature resistance, the capsule wall will not result in fusing deformation, aerosol vapor flows directly out of the capsule wall with burst. After burning, burst capsule wall material will be remained in cigarette, drop out with ash. Through experiments discovered, the materials of microburst-microcapsule wall which can be fused or not, especially metal foil, low temperature glass and ceramic, will not generate harmful chemicals during the cigarette burning.

Figure 7:
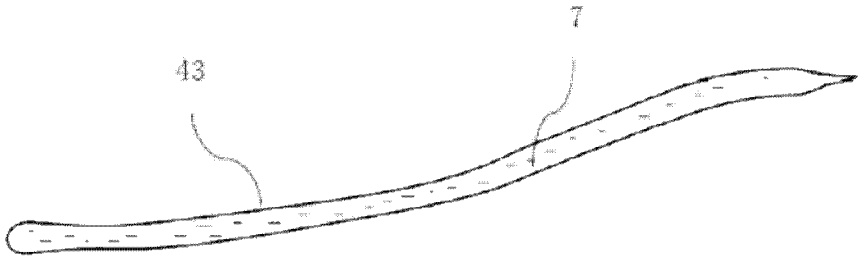
FIG. 7 displays the front view of microburst-microcapsule application embodiment III in the invention. A kind of representative fine-fiber-like microburst-microcapsule filled with aerosol generation materials can be seen here.

As shown in FIG. 7, a typical filament-like microburst-microcapsule with liquids filled internally, the capsule wall 43 of such filamentous microburst-microcapsules is made of low-temperature alloy with high flexibility, preferably the aluminum alloy foil, copper alloy foil, tin alloy foil, nickel alloy foil, at a suitable temperature, fill aerosol generation material 7, while stretching. As an alternative, it can be made of low-temperature glass with low melting point less than 250° C. through the same method. The rolling process of microburst-microcapsules and carbonaceous fuel mentioned above will have good usability. So when smokers smoke, the burst noise will be small. In this embodiment, weighted by percentage, the aerosol generation material comprises 60% of propylene glycol, 30% glycerol, 5% of water and 5% ethanol. As for the weight of the filed aerosol in each microburst-microcapsule, it can be controlled between 1 mg to 50 mg.

Preferably, take cellulose as raw materials like nature cellulose and any other kind of synthetic fiber; dissolve it by the solvent, then use spinning process to make it into a hollow fiber, forming the capsule wall 43 of microburst-microcapsules. In the spinning process, simultaneously add the aerosol generation material 7, forming the filamentous microburst-microcapsules with cellulose capsule wall and liquid filled internally. After such filamentous microburst-microcapsules mixed with combustion materials, roll it into a cigarette with a wrapping paper.

When the smoking article is lighted, low flash point cellulose will be combusted and decomposed. Cellulose with high flash point will fuse to deformation; and cellulose with even higher flash point will not fuse and no deformation.

Figure 8:
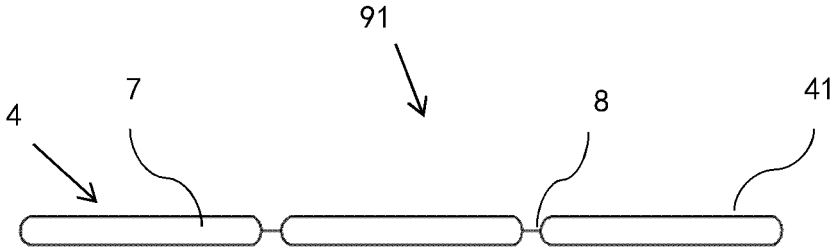
FIG. 8 is the front view of the embodiment I for siamesed microburst-microcapsules in this invention, in which the siamesed microburst-microcapsules are in a flat state. After filling liquid, the metal foil is successively encapsulated into the single string-like microburst-microcapsules.
Figure 9:
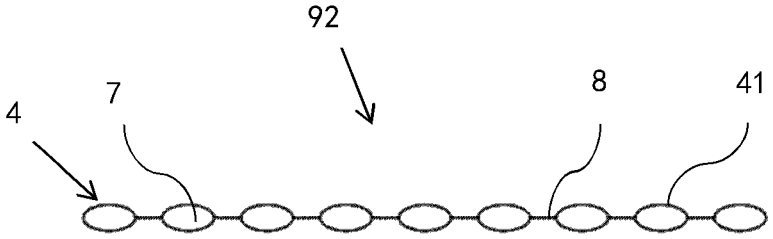
FIG. 9 is the front view of the embodiment II for siamesed microburst-microcapsules in this invention, in which the siamesed microburst-microcapsules are in a flat state. After filling liquid, the metal foil is successively encapsulated into the single string-like microburst-microcapsules.

FIGS. 8 and 9 show that a representative thin metal foil tubule, after filling liquid, by successive encapsulations, becomes siamesed microburst-microcapsules 91 and 92, that is, between two microburst-microcapsules 4 is the sealing portion 8 of the capsule wall, which is formed in the packaging process, dividing each independent microburst-microcapsules 4. When producing a cigarette, one or more siamesed microburst-microcapsules 91, 92 should set longitudinally within the combustion material of the tobacco. Two siamesed microburst-microcapsules can be adjacent, but also may be spaced apart, substantially are parallel to the longitudinal axis of the cigarette, thus making the smoke generated more continuous and stable. Particularly preferred, the siamesed microburst-microcapsules 91, 92 are longitudinally set in the central axis of the combustion material.

As is shown in FIGS. 8 and 9, the individual microburst-microcapsule 4 in siamesed microburst-microcapsules appear in differentiated shapes. The above-mentioned sealing portion 8 is where the capsule walls are jointed. If it is cut here and the trim charge removed, a number of independent microburst-microcapsules 4 will become available.

The siamesed microburst-microcapsule 91 and 92 are directly filled together with combustion materials, in appropriate length, based on actual circumstances. The optimal quantity of aerosol generation materials added into siamesed microburst-microcapsule 91 and 92 ranges from 5 mg to 150 mg.

Figure 10:
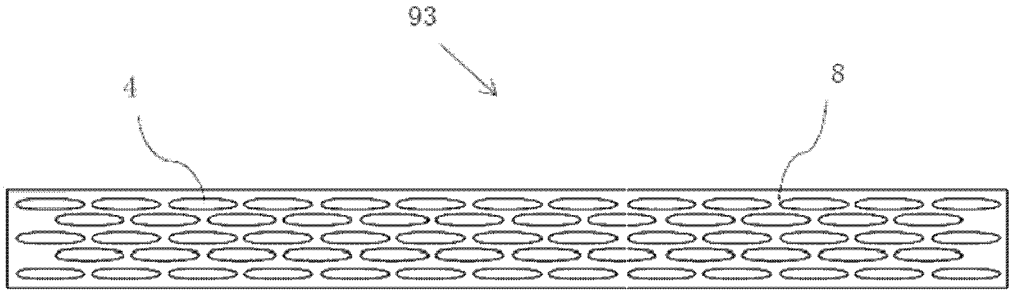
FIG. 10 is the front view of the embodiment III for siamesed microburst-microcapsules in this invention, wherein the siamesed microburst-microcapsules are in a flat state, viewed from above, which shows that, after filling liquid, the metal foil is successively encapsulated into multi-column string-like microburst-microcapsules, wherein the microburst-microcapsules is elongated columnar.
Figure 11:
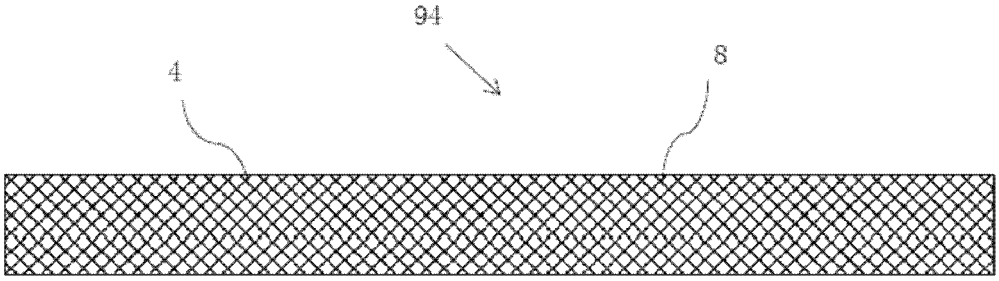
FIG. 11 is the front view of the embodiment IV for siamesed microburst-microcapsules in the invention, in which the siamesed microburst-microcapsules are in a flat state, viewed from above, which shows that, after filling liquid, the metal foil is successively encapsulated into multi-column string-like microburst-microcapsules, wherein the microburst-microcapsules has square shape.

As is shown in FIGS. 10 and 11, the invention provides another two kinds of siamesed microburst-microcapsules—93 and 94. Similarly the capsule wall is made of the metal foil coated with thermo sensitive glues and undergoes die-based thermo compression sealing with regularly-arranged flanges. During the thermo compression sealing process, the liquid aerosol generation materials are filled. The finished product is strip-shaped and composed of lots of independently-sealed and well-arranged microburst-microcapsules 4. Lots of microburst-microcapsules 4 are jointed together by the sealing portion 8 in between capsule walls. The individual microburst-microcapsule 4 shown in FIG. 10 is long and circular, and sealing portion 8 joints the two individual ones together. The individual microburst-microcapsule 4 in FIG. 4 is in squared shape, and the two individual ones are jointed together by the sealing portion 8 which is uniformly distributed in vertical and horizontal lines. During practices, the microburst-microcapsules can be cut in random size, based on product requirements and the number of microburst-microcapsules. For each siamesed microburst-microcapsule, the total quantity of filled liquid can range from 5 mg to 150 mg. During the cigarette manufacturing process, the siamesed microburst-microcapsules 93 and 94 are each placed, in procumbent or columnar manner, in the middle of the cigarette combustion materials. Alternatively they are wrapped along cigarette sides. Based on actual circumstances, 2 or more than 2 siamesed microburst-microcapsules can be placed within cigarette. The application of siamesed microburst-microcapsules in this invention is helpful for generating of uniform, continuous and stable aerosol. Besides, it makes the cigarette manufacturing easier.

The microburst-microcapsule can be a column or flake shaped. The microburst-microcapsule can has one or more cavities which filled with aerosol generation material, and the microburst-microcapsule can be wrapped in cigarette or insert into a normal cigarette.

What has been discussed above constitutes only part of the modes of execution in the invention. Aforesaid descriptions of specific modes of execution aim to explain the technical solutions involved in the invention. Such modes of execution are described to reveal the optimal modes of execution of the invention, giving ordinary technicians of the focusing area an access to various modes of execution exclusive to the invention and lots of other alternatives to achieve goals of the invention. Those obvious alterations or substitutes inspired by the invention should be deemed as a component of the invention.

What is claimed is:

1. A smoking article comprising, a microburst-microcapsule, the microburst-microcapsule is filled into a body of the smoking article, the microburst-microcapsule consists of a microcapsule wall, the wall is formed without the use of film-forming substances, and an aerosol generation material packaged therein, wherein the smoking article is a cigarette and when the cigarette is lit, heat generated from a combustion zone of the cigarette vaporizes the adjacent aerosol generation material in the microburst-microcapsule and a vapor pressure causes the microcapsule wall to burst and an aerosol generated from the aerosol generation material flows out of the microcapsule wall, the body comprises a mixture of a combustion material and the microburst-microcapsule.

2. The smoking article of claim 1, wherein the heat from the combustion zone causes a fusing deformation of the microcapsule wall.

3. The smoking article of claim 2, wherein the microcapsule wall is one of metal foil, low temperature glass, having sufficiently high temperature resistant polymer material, ceramic material and cellulose.

4. The smoking article of claim 1, wherein the heat from the combustion zone does not cause a fusing deformation of the microcapsule wall.

5. The smoking article of claim 4, wherein the microcapsule wall is made of a capsule wall material with sufficiently high temperature resistance, wherein the capsule wall material is one of aluminum foil, copper foil, nickel foil, polymer material with sufficiently high temperature resistance, and ceramic material.

6. The smoking article of claim 1, wherein a lateral diameter of the microburst-microcapsule perpendicular to a direction of a length of the cigarette is less than 2 mm.

7. The smoking article of claim 6, wherein the aerosol generation material packaged in the microburst-microcapsule has the weight of 0.0001 mg to 50 mg.

8. The smoking article of claim 1, wherein a shape of the microburst-microcapsule is one of strip shaped, spherical, hemispherical, oblong, semi-oblong, flat, cylindrical, square shaped, granular, and filamentary, wherein the microburst-microcapsule has a wall with a surface and the surface of the wall has pre-burst cracks formed therein.

9. The smoking article of claim 1, wherein the aerosol generation material consists essentially of the following ingredients by mass:

propylene glycol 20-100%,
glycerol 0-80%,
tobacco extracts (dry weight) 0-30%,
nicotine 0-10%,
monobasic and dibasic C1-C6 organic acids 0-10%,
tobacco Flavors 0-10%,
ethanol 0-10%, and
water 0-10%.

10. A smoking article comprising, a siamesed microburst-microcapsule, the siamesed microburst-microcapsule is filled into a body of the smoking article, the siamesed microburst-microcapsule consists of a microcapsule wall, the wall is formed without the use of film-forming substances, and an aerosol generation material packaged therein, the smoking article is a cigarette and when the cigarette is lit, heat generated from a combustion zone of the cigarette vaporizes the adjacent aerosol generation material in the siamesed microburst-microcapsule and a vapor pressure causes the microcapsule wall to burst and an aerosol generated from the aerosol generation material flows out of the microcapsule wall, the body comprises a mixture of a combustion material and the siamesed microburst-microcapsule, and the siamesed microburst-microcapsule comprises a plurality of microburst-microcapsules connected through a microcapsule wall by a sealing part in between the microcapsule wall.

11. The smoking article of claim 10, wherein a shape of the microcapsule wall is tubular, and the siamesed microburst-microcapsule is made by stretching a metal foil, low temperature glass, polymer material or ceramic material, depositing into the siamesed microburst-microcapsule an aerosol generation material and enclosing the microburst-microcapsule to define the capsule.

12. The smoking article of claim 1, wherein the microburst-microcapsule is used as a signal product having one or more cavities filled with the aerosol generation material, wherein the microburst-microcapsule is wrapped in the cigarette or inserted into the cigarette by a smoker to use.

* * * * *